United States Patent [19]

Shackle et al.

[11] 4,336,067

[45] * Jun. 22, 1982

[54] HOT MELT CHROMOGENIC COATING COMPOSITION

[75] Inventors: Dale R. Shackle; Ainslie T. Young, Jr., both of Chillicothe, Ohio

[73] Assignee: The Mead Corporation, Dayton, Ohio

[ * ] Notice: The portion of the term of this patent subsequent to Dec. 20, 1994, has been disclaimed.

[21] Appl. No.: 134,406

[22] Filed: Mar. 27, 1980

Related U.S. Application Data

[63] Continuation of Ser. No. 830,987, Sep. 6, 1977, abandoned.

[51] Int. Cl.[3] ..... B41M 5/22

[52] U.S. Cl. ..... 106/21; 106/27; 106/30; 106/31; 106/308 R; 106/308 Q; 106/308 F; 106/308 M; 252/316; 282/27.5; 427/150; 427/151; 427/153; 428/488; 428/537; 428/914; 524/277; 524/274; 524/291; 525/138; 525/145

[58] Field of Search ..... 106/21, 19, 20, 22, 106/23, 27–32, 288 R, 308 N, 308 R, 308 Q, 308 F, 308 M; 282/27.5; 427/146, 150, 151, 152, 153; 428/307, 488, 913, 914, 211, 484, 485, 486, 537, 320.2, 320.4, 320.6, 320.8; 252/316; 260/28 R, 28 P, 28.5 R, 29.1 R, 32.8 R, 37 R, 37 NP, 37 P, 38, 42.43

[56] References Cited

U.S. PATENT DOCUMENTS 3,079,351 2/1963 Staneslow et al. ..... 282/27.5

3,871,900 3/1975 Hayashi et al. ..... 282/27.5

4,063,754 12/1977 Shackle et al. ..... 282/27.5

*Primary Examiner*—Bruce H. Hess

*Attorney, Agent, or Firm*—S. H. Cagle; C. N. Shane, Jr.; W. G. Palmer

[57] ABSTRACT

A process is provided for producing a pressure-sensitive carbonless record sheet comprising the steps of preparing a hot melt coating composition, the hot melt coating composition being water insoluble and having a melting point of from about 60° C. to about 140° C. The hot melt coating composition includes a chromogenic material. The chromogenic material is a meltable color developer of the acidic electron accepting type. The hot melt coating composition is heated to a temperature above its melting point and the heated coating composition is applied to a substrate, the coating composition being applied at a coat weight of from about 0.2 pounds to about 8.0 pounds per 3300 square feet of substrate. The coating composition is set by cooling the coated substrate. A novel liquid chromogenic coating composition is produced, the coating composition having a melting point of from about 60° C. to about 140° C. and comprising from about 15% to about 100% of a chromogenic material and from about 0% to about 80% of a rheology modifying material, the chromogenic material being a meltable color developer of the acid electron accepting type. A pressure-sensitive record sheet is produced, the record sheet comprising a substrate having a plurality of surfaces, at least one of the surfaces being coated with a set hot melt coating composition, the set hot melt suspending medium including a chromogenic material dispersed therein.

7 Claims, No Drawings

HOT MELT CHROMOGENIC COATING COMPOSITION

This is a continuation, of application Ser. No. 830,987, filed Sept. 6, 1977, now abandoned.

BACKGROUND OF THE INVENTION

This invention relates to the production of pressure-sensitive carbonless record sheets for use in combination with a pressure-sensitive transfer sheet of the type whereby on application of pressure a color precursor is transferred to the record sheet which then develops a visible image. More particularly, it relates to the production of a pressure-sensitive carbonless record sheet utilizing a hot melt system to form a coating composition containing a chromogenic material, which coating is set by cooling. For purposes of this application the term "chromogenic" shall be understood to refer to chromogenic material such as color developers, color formers and may additionally contain color inhibitors and the like. The term shall be understood to refer to such materials whether in microencapsulated, capsulated, dispersed or other form. For purposes of this application the term CF, shall be understood to refer to a coating normally used on a record sheet. In addition the term CB shall be understood to refer to a coating normally used on a transfer sheet.

Carbonless paper, briefly stated, is a standard type of paper wherein during manufacture the backside of a paper substrate is coated with what is referred to as a CB coating, the CB coating containing one or more color precursors generally in capsular form. At the same time the front side of the paper substrate is coated during manufacture with what is referred to as a CF coating, which contains one or more color developers. Both the color precursor and the color developer remain in the coating compositions on the respective back and front surfaces of the paper in colorless form. This is true until the CB and CF coatings of adjacent sheets are brought into abutting relationship and sufficient pressure, as by a typewriter, is applied to rupture the CB coating to release the color precursor. At this time the color precursor contacts the CF coating and reacts with the color developer therein to form an image. Carbonless paper has proved to be an exceptionally valuable image transfer medium for a variety of reasons only one of which is the fact that until a CB coating is placed next to a CF coating both the CB and the CF are in an inactive state as the co-reactive elements are not in contact with one another. Patents relating to carbonless paper products are:

U.S. Pat. No. 2,712,507 (1955) to Green
U.S. Pat. No. 2,730,456 (1956) to Green et al
U.S. Pat. No. 3,455,721 (1969) to Phillips et al
U.S. Pat. No. 3,466,184 (1969) to Bowler et al
U.S. Pat. No. 3,672,935 (1972) to Miller et al A third generation product which is an advanced stage of development and commercialization at this time and which is available in some business sectors is referred to as self-contained paper. Very generally stated self-contained paper refers to an imaging system wherein only one side of the paper needs to be coated and the one coating contains both the color precursor, generally in encapsulated form, and the color developer. Thus when pressure is applied, again as by a typewriter or other writing instrument, the color precursor capsule is ruptured and reacts with the surrounding color developer to form an image. Both the carbonless paper image transfer system and the self-contained system have been the subject of a great deal of patent activity. A typical autogeneous record material system, earlier sometimes referred to as "self-contained" because all elements for making a mark are in a single sheet, is disclosed in U.S. Pat. No. 2,730,457 (1956) to Green.

A disadvantage of coated paper products such as carbonless and self-contained stems from the necessity of applying a liquid coating composition containing the color forming ingredients during the manufacturing process. In the application of such coatings volatile solvents are sometimes used which then in turn requires evaporation of excess solvent to dry the coating thus producing volatile solvent vapors. An alternate method of coating involves the application of the color forming ingredients in an aqueous slurry, again requiring removal of excess water by drying. Both methods suffer from serious disadvantages. In particular the solvent coating method necessarily involves the production of generally volatile solvent vapors creating both a health and a fire hazard in the surrounding environment. In addition, when using an aqueous solvent system the water must be evaporated which involves the expenditure of significant amounts of energy. Further, the necessity of a drying step requires the use of complex and expensive apparatus to continuously dry a substrate which has been coated with an aqueous coating compound. A separate but related problem involves the disposal of polluted water resulting from the preparation and cleanup of the aqueous coating compositions. The application of heat not only is expensive, making the total product manufacturing operation less cost effective, but also is potentially damaging to the color forming ingredients which are generally coated onto the paper substrate during manufacture. The problems encountered in the actual coating step are generally attributable to the necessity for a heated drying step following the coating operation.

Many of the particular advantages of the process and product of this invention are derived from the fact that a hot melt coating composition is used to coat the paper substrate. This is in contrast to the coatings used by the prior art which have generally required an aqueous or solvent coating. For purposes of this application the term "100% solids coating" will sometimes be used to describe the coating operation and should be understood to refer to the fact that a hot melt coating composition is used and therefore the drying step normally present in the manufacture of paper and in coating has been eliminated.

In this regard, it should be noted that spot coating of aqueous and solvent systems has been known. See, for example, Vassiliades, U.S. Pat. Nos. 3,914,511, Macauley (3,016,308), Staneslow et al. (3,079,351), Miller et al. (3,672,935), and Shank (3,684,549). But to the best of our knowledge none of the hot melt coatings of the past are particularly effective.

Therefore, the need exists for an improved hot melt system for coating CF carbonless paper sheets so that spot coated sheets can be prepared. Additionally, the most preferred embodiment of this invention relates to a process for the continuous production of manifold carbonless forms and more particularly to a process for utilizing a hot melt system containing dispersed color developing material.

As can be appreciated from the above the continuous production of a manifold paper product would require simultaneous coating, simultaneous drying, simultaneous printing, and simultaneous collating and finishing of a plurality of paper substrates. Thus, Busch in Canadian Pat. No. 945,443 indicates that in order to do so there should be a minimum wetting of the paper web by water during application of an emulsion coat. For that purpose a high solids content emulsion is used and special driers are described in Busch. However, because of the complexities of the drying step this process has not been commercially possible to date. More particularly, the drying step involving solvent evaporation and/or water evaporation and the input of heat does not permit the simultaneous or continuous manufacture of manifold forms. In addition to the drying step which prevents continuous manifold form production the necessity for the application of heat for solvent evaporation in a serious disadvantage since aqueous and other liquid coatings require that special grades of generally more expensive paper be employed and even these often result in buckling, distortion or warping of the paper since water and other liquids tend to strike through or penetrate the paper substrate. Additionally, aqueous coatings and some solvent coatings are generally not suitable for spot application or application to limited areas of one side of a sheet of paper. They are generally suitable only for application to the entire surface area of a sheet to produce a continuous coating.

Another problem which has been commonly encountered in attempts to continuously manufacture manifold forms has been the fact that a paper manufacturer must design paper from a strength and durability standpoint to be adequate for use in a variety of printing and finishing machines. This requires a paper manufacturer to evaluate the coating apparatus of the forms manufacturers he supplies in order that the paper can be designed to accommodate the apparatus and process exhibiting the most demanding conditions. Because of this, a higher long wood fiber to short wood fiber ratio must be used by the paper manufacturer than is necessary for most coating, printing or finishing machines in order to achieve a proper high level of strength in his finished paper product. This makes the final sheet product more expensive as the long fiber is generally more expensive than a short fiber. In essence, the separation of paper manufacturer from forms manufacturer, which is now common, requires that the paper manufacturer overdesign his final product for a variety of machines, instead of specifically designing the paper product for known machine conditions.

By combining the manufacturing, printing and finishing operations into a single on-line system a number of advantages are achieved. First, the paper can be made using groundwood and a lower long fiber to short fiber ratio as was developed supra. This is a cost and potentially a quality improvement in the final paper product. A second advantage which can be derived from a combination of manufacturing, printing and finishing is the waste or re-cycled paper, hereinafter sometimes referred to as "broke," can be used in the manufacture of the paper since the quality of the paper is not of an overdesigned high standard. Third, and most important, several steps in the normal process of the manufacture of forms can be completely eliminated. Specifically, drying steps can be eliminated by using a non-aqueous, solvent-free coating system and in addition the warehousing and shipping steps can be avoided thus resulting in a more cost efficient product.

Additionally, by using appropriate coating methods, namely hot melt coating compositions and methods, and by combining the necessary manufacturing and printing steps, spot printing and spot coating can be realized. Both of these represent a significant cost savings, but nevertheless one which is not generally available when aqueous or solvent coatings are used or where the manufacture, printing and finishing of paper are performed as separate functions. An additional advantage of the use of hot melt coating compositions and the combination of paper manufacturer, printer and finisher is that when the option of printing followed by coating is available significant cost advantages occur.

STATEMENT OF THE INVENTION

A process is provided for producing a pressure-sensitive carbonless record sheet comprising the steps of preparing a hot melt coating composition, the hot melt coating composition being water insoluble and having a melting point of from about 60° C. to about 140° C. The hot melt coating composition includes a chromogenic material. The chromogenic material is a meltable color developer of the acidic electron accepting type. The hot melt coating composition is heated to a temperature above its melting point and the heated coating composition is applied to a substrate, the coating composition being applied at a coat weight of from about 0.2 pounds to about 8.0 pounds per 3300 square feet of substrate. The coating composition is set by cooling the coated substrate. A novel liquid chromogenic coating composition is produced, the coating composition having a melting point of from about 60° C. to about 140° C. and comprising from about 15% to about 100% of a chromogenic material and from about 0% to about 80% of a rheology modifying material, the chromogenic material being a meltable color developer of the acid electron accepting type. A pressure-sensitive record sheet is produced, the record sheet comprising a substrate having a plurality of surfaces, at least one of the surfaces being coated with a set hot melt coating composition, the set hot melt suspending medium including a chromogenic material dispersed therein.

DETAILED DESCRIPTION OF THE INVENTION

The chromogenic coating composition of this invention is essentially a water insoluble, meltable color developer. In a preferred form, rheology modifying materials, such as resins, waxes and liquid plasticizers, can be added to improve the coatability of the coating composition in a hot melt system. The color developer and rheology modifying materials are preferably miscible or partially miscible in melted form so that separation of the components of the composition does not occur during the application of the hot melt coating composition.

Filler materials can also be added to the coating composition, if desired. The use of solvents, which require heat to remove them during the drying or setting of the coating composition, is avoided. However, minor amounts of solvents can be tolerated without requiring a separate step of drying during any subsequent setting step. Although the product and process of this invention are useful in the manufacture of a variety of products the preferred use of the process and product of this invention is in the continuous production of a manifold carbonless substrate.

The chromogenic color developers most useful in the practice of this invention are the acidic electron-acceptors and include phenolic materials such as 2-ethylhexyl gallate, 3,5-di-tert-butyl salicylic acid, phenolic resins of the novolak type and metal modified phenolic materials, such as the zinc salt of 3,5-di-tert-butyl salicylic acid and the zinc modified novolak type resins. The most preferred chromogenic color developers are the novolaks of p-phenylphenol, p-octylphenol and p-tert-butylphenol and their zinc modifications. Mixtures of these color developers may be used, if desired. The resinuous color developers can be used as the sole component of the hot melt coating composition providing the viscosity of the composition at coating temperatures is low enough to permit the composition to be coated or printed by the desired method as is hereinafter developed, rheology modifying materials selected to lower the viscosity of these resins can be added. Phenolic compounds, such as 2-ethylhexyl gallate and 3,5-di-tert-butyl salicylic acid generally have a sharper melting point and lower melt viscosity. In this case, rheology modifying materials selected to raise the viscosity of these compounds are generally added.

The color developers can be present in the hot melt coating composition in the range of from about 15% to about 100% by weight of the coating composition. At 100% the color developers function as the hot melt in addition to their chromogenic function. The preferred range of color developer in the coating composition is from about 50% to about 100% and the most preferred range is from about 65% to about 85%.

The rheology modifying materials generally useful in the practice of this invention include a wide variety of resins, waxes and liquid plasticizers. In general, these rheology modifying materials can be non-polar or polar. By polar it is meant that a certain amount of polarity is characteristic of these materials, the polar materials being characterized by the presence of functional groups selected from the group consisting of carboxyl, carbonyl, hydroxyl, ester, amide, amine, heterocyclic groups and combinations thereof. The rheology modifying materials may vary in viscosity from liquids such as monoisopropylbiphenyl to the low molecular weight polypropylenes. Examples of rheology modifying materials which may be used are polyethylenes and polypropylenes, polyethylene glycols, polystyrenes, polyesters, polyacrylates, rosin, modified rosins, polyphenyls, fatty acid derivatives, oxazoline waxes, Montan waxes, paraffin waxes and microcrystalline waxes. The rheology modifying materials may be present in an amount of from about 0% to about 85% by weight of the hot melt coating composition. The preferred range is from about 0% to about 50% and the most preferred range is from about 15% to about 35% of the coating compositions.

A desirable characteristic of the hot melt coating composition of this invention is a melting point of from about 60° C. to about 140° C., although a more preferred melting point for the coating compositions is from about 70° C. to about 100° C. Also relative to the melting point, it is desirable for the coating composition of this invention to set rapidly after application to the particular substrate. More specifically, a practical melting range limitation or in other words range of temperature in which the liquid hot melt coating composition sets into a solid composition, is from about 0.1° C. to about 15° C. The preferred setting time is from about 0.5 seconds to about 5 seconds while the most preferred setting time is from about 0.5 seconds to about 2 seconds. While hot melt compositions having a melting range of more than 15° C. can be used, the time necessary for such a coating composition to set requires special apparatus and handling and makes use of these hot melt compositions commercially unattractive.

The preferred hot melt coating compositions of this invention have a low viscosity when in a molten state in order to facilitate ease of spreading on the substrate. In general, it is desirable that the hot melt coating composition have a viscosity of less than about 500 centipoises at a temperature of approximately 5° above the melting point of a particular hot melt coating composition. In addition, it is preferred that the hot melt coating composition of this invention have a light color in order to be compatible with the final paper or plastic product being produced. This means that it is preferred for the hot melt to be white or colorless after application to the particular substrate being coated.

Filler materials can be added to the coating composition as flattening agents to reduce the glossy appearance of the cured hot melt coatings and preserve the appearance of the substrate. Thus a bond paper which has been coated with the coating composition of this invention and which is then cured to a solid gives the impression of being an uncoated bond paper. The preferred filler materials are of the colloidally precipitated or fumed silicas. Typical of the silicas which can be used are the ones tradenamed LoVel 27 (a precipitated silica manufactured and sold by PPG Industries, Inc., Pittsburgh, Pa.), Syloid 72 (a hydrogel silica manufactured and sold by W. R. Grace & Co., Davison Chemical Division, Baltimore, Md.) and Cab-o-sil (a fumed silica manufactured and sold by Cabot Corporation, Boston, Mass.). All of these silicas are known to give an initial bluish color with color precursors such as crystal violet lactone. However, this color fades quickly on aging. Using the record sheet produced by the process of this invention, the developed color does not fade easily. The filler material through its large surface area provides for increased porosity of the cured resin film, thereby promoting more rapid and more complete transfer of an oil solution of color precursors from a transfer sheet to the record sheet surface. The amount of filler materials can be up to about 15% by weight of the coating composition and the preferred range is from about 1% to about 10% by weight.

The chromogenic color developing coating composition can be applied hot to a substrate, such as paper or a plastic film by any of the common paper coating processes, such as roll, blade coating or by any of the common printing processes, such as planographic, gravure, or flexographic printing. The rheological properties, particularly the viscosity of the coating composition, can be adjusted for each type of application by proper selection of the type and relative amounts of rheology modifying materials. While the actual amount of the hot melt coating composition applied to the substrate can vary depending on the particular final product desired, for purposes of coating paper substrates, the practical range of coat weights for the CF chromogenic coating compositions of this invention are from about 0.2 pounds to about 8 pounds per 3300 square feet of substrate, the preferred range being from about 0.2 pounds to about 5 pounds per 3300 square feet of substrate and the most preferred range being from about 0.2 pounds to about 2.5 pounds per 3300 square feet of substrate. Coat weights above the most preferred range do not show any substantial improvement over those within the most preferred range.

These hot melt coating compositions can be set by any cooling means. Preferably a chill roll is used on the coating apparatus which cools the hot melt coating immediately after coating, but is also quite common to simply allow the coating composition to cool naturally by atmospheric pressure. As the temperature of the coating composition is substantially higher than room temperature and in light of the fact that the coating thickness is generally less than 50 microns it can be seen that when spread out over a coated substrate the hot melt material cools very rapidly. The actual exposure or chill time necessary for setting of the chromogenic coating composition is dependent on a number of variables, such as coat weight, the particular color developers and rheology modifying materials used, type of cooling means, temperature of the cooling means and others.

In the preferred application of the process and products of this invention a manifold carbonless form is produced. In this process a continuous web is marked with a pattern on at least one surface. A non-aqueous, solvent free hot melt coating of chromogenic material is applied to at least a portion of at least one surface of the continuous web. The coated surface is then set by cooling. The continuous web having the set coating is then combined with at least one additional continuous web which has been previously or simultaneously coated with a hot melt material and set by cooling. A manifold carbonless form is then made by a variety of collating and finishing steps. Such a process and product are described in commonly assigned, co-pending application entitled "Manifold Carbonless Form and Process for the Production Thereof (Custom)" filed on even date herewith and which is incorporated herein by reference.

In the most preferred application of the process and products of this invention a manifold form is continuously produced. In this most preferred embodiment a plurality of continuous webs are advanced at substantially the same speed, the plurality of continuous webs being spaced apart and being advanced in cooperating relationship with one another. At best one web of the plurality of continuous webs is marked with a pattern and at least one nonaqueous, solvent-free hot melt coating containing the chromogenic material is applied to at least a portion of at least one of the plurality of continuous webs. The hot melt material is then set by cooling. The continuous webs are then collated and placed in contiquous relationship to one another to create a manifold form. After the continuous webs are placed in collated, contiguous relationship they can be finished by any combination of the steps of combining, partitioning, stacking, packaging and the like. Such a process and product are described in commonly-assigned, co-pending application entitled "Manifold Carbonless Form and Process for the Continuous Production Thereof (Standard)" filed o even date herewith and which is incorporated herein by reference.

Examples I–III illustrate the preparation of such a hot melt CF coating. In that regard it is noted that in actual practice in color developers are mainly novolak resins of the substituted phenol-formaldehyde variety, either zincated, unzincated or a mixture of zincated and unzincated resins. The hot melt liquid can be composed of about 15 to about 100% of these resins and up to about 85% by weight of a rheology modifying material. Generally, these rheology modifying materials can be taken from a variety of inert high boiling liquid plasticizers or non-crystalline or microcrystalline solids such as resins and waxes with melting points less than 110° C.

The set, coated paper was tested by placing the coated surfaces thereof in contact with the coated side of a paper coated with gelatin microcapsules containing a marking oil made up of 180 parts of monoisopropylbiphenyl, 5.3 parts of crystal violet lactone, 0.62 parts of 3,3-bis-(1-ethyl-2-methylindol-3-yl)-phthalide, 1.25 parts of 3-N-N-diethylamino-7-(N,N-dibenzylamino)-fluoran, and 0.95 parts of 2,3-(-1'-phenyl-3'-methylpyrazolo)-7-diethylamino-4-spirophthalido-chromene and 122 parts of odorless kerosene. These sheet couples were imaged with an electric typewriter using the character "m" in a repeating block pattern, and the intensity of the images were measured as the ratio of the reflectance of the imaged area to the reflectance of the unimaged background, after an elapsed time of 10 minutes. Thus, the more intense or darker images show as lower values, the higher values indicate weak or faint images. This test is called Typewriter Intensity and may be expressed mathematically as $$T.I. = (100)R_o/R_i$$

where $R_i$ is reflectance of the imaged area and $R_o$ is reflectance of the background (unimaged) area as measured with a Bausch and Lomb Opacimeter.

The following examples illustrate but do not limit the invention as defined in the claims.

EXAMPLE I

A mixture of 15 parts by weight of zincated p-octylphenol novolak resin (4.3% Zn) and 5 parts by weight of p-phenylphenol novolak resin were mixed in a metal beaker and heated with continuous stirring to 120° C. This hot liquid was drawn down on a paper substrate weighing 13.5 pounds per 3300 square foot with a hot blade to give a 1.2 pound coating of the resin mixture on the substrate. The resulting tackless coating had a slight gloss and a faint yellow color and gave a typewriter intensity value of 68.

EXAMPLE II

The following mixture in parts by weight of novolak resins and binder materials was mixed in a metal container and melted in an oven at 120° C. The following are given in parts by weight:

761 parts p-phenylphenol novolak resin
2284 parts zincated p-octylphenol novolak resin (4.3% Zn)
471 parts mono-isopropylbiphenyl
109 parts Epolene M-85 (Eastman, a low M.W. polypropylene)

The resulting hot liquid was coated on a paper substrate weighing 13 pounds on a gravure hot melt coater. The coater contained a heated 200 lines per inch quadrangular machine etched gravure roll at 150° C. and a heated smoothing roll. The hot liquid resin mixture was applied to the paper substrate at a speed of 130 feet per minute to give a cost weight of 0.48 pounds per 3300 square feet. Typing intensity of the sheet was 83.

EXAMPLE III

A series of hot melt coating compositions containing color developers were prepared and coated on a paper substrate as in Example I. In each instance, the coating composition was applied at a coat weight of at least 3 pounds per 3300 square feet of paper. The composition of the hot melts and Typewriter Intensities for each coated paper are given in Table I as follows.

TABLE 1

| | Rheology Modifying Material | | | | Color Developer | | | Typewriter |
|---|---|---|---|---|---|---|---|---|
| | Modifying Material | Manufacturer | Chemical Composition | % | % PPP | % ZOP | % ZDBSA | Intensity of Coated Paper |
| 1. | Carbowax 4000 | Union Carbide Corp. | Polyethylene glycol | 20 | 80 | 0 | 0 | 73 |
| 2. | Carbowax 4000 | Union Carbide Corp. | Polyethylene glycol | 60 | 40 | 0 | 0 | No Image |
| 3. | Santowax R | Monsanto Co. | Substituted terphenyls | 20 | 80 | 0 | 0 | 64 |
| 4. | Santowax R | Monsanto Co. | Substituted terphenyls | 60 | 40 | 0 | 0 | 59 |
| 5. | Santowax R | Monsanto Co. | Substituted terphenyls | 15 | | | | |
| | Epolene N-11-P | Eastman Kodak Co. | Polyethylene | 15 | 70 | 0 | 0 | 67 |
| 6. | Epolene M-85 | Eastman Kodak Co. | Polypropylene | 20 | 20 | 60 | 0 | 73 |
| 7. | Dow Resin PS-2 | Dow Chemical Co. | Polystyrene | 20 | 80 | 0 | 0 | 63 |
| 8. | Kristalex 3085 | Hercules, Inc. | Poly-α-methyl styrene | 20 | 80 | 0 | 0 | 61 |
| 9. | Arolon 503-A8-88 | Ashland Oil, Inc. | Polyester | 20 | 20 | 60 | 0 | 68 |
| 10. | Arolon 557-D-70 | Ashland Oil, Inc. | Acrylic resin | 20 | 20 | 60 | 0 | 71 |
| 11. | Cellolyn 21 | Hercules, Inc. | Phthalate ester of technical Hydroabietyl alcohol | 20 | 80 | 0 | 0 | 64 |
| 12. | Hercolyn D | Hercules, Inc. | Hydrogenated methyl ester of rosin, steam distilled | 20 | 80 | 0 | 0 | 65 |
| 13. | Hercolyn D | Hercules, Inc. | Hydrogenated methyl ester of rosin, steam distilled | 20 | 20 | 60 | 0 | 66 |
| 14. | Piccolastic A-75 | Hercules, Inc. | Styrene & related monomer resin | 20 | 80 | 0 | 0 | 59 |
| 15. | Piccolastic A-5 | Hercules, Inc. | Styrene & related monomer resin | 20 | 20 | 60 | 0 | 69 |
| 16. | Abalyn | Hercules, Inc. | Methyl ester of rosin | 20 | 80 | 0 | 0 | 62 |
| 17. | Stabelite Ester 3 | Hercules, Inc. | Triethylene glycol ester of hydrogenated rosin | 20 | 80 | 0 | 0 | 66 |
| 18. | Biphenyl | | Biphenyl | 30 | 70 | 0 | 0 | 68 |
| 19. | Glycowax S-932 | Glyco Chemicals, Inc. | Tristearin | 20 | 70 | 0 | 10 | 68 |
| 20. | Oxawax TS-254AA | International Minerals & Chemicals Corp. | Oxazoline wax | 50 | 12.5 | 37.5 | 0 | 80 |
| 21. | Komamide S | Humko-Sheffield Chemical | Stearamide | 50 | 12.5 | 37.5 | 0 | 74 |
| 22. | Hoechst UT-CA | American Hoechst Corp. | Montan wax with high acid no. | 50 | 12.5 | 37.5 | 0 | 74 |
| 23. | Cerit Fac 3 | Durachem Commodities Corp. | 12-Hydroxystearic acid | 50 | 12.5 | 37.5 | 0 | 80 |
| 24. | MIPB | Monsanto Co. | Monoisopropylbiphenyl | 30 | 17.5 | 52.5 | 0 | 72 |
| 25. | MIPB | Monsanto Co. | Monoisopropylbiphenyl | 10 | | | | |
| | Glycowax S-932 | Glyco Chemicals, Inc. | Tristearin | 10 | 15 | 45 | 20 | 75 |
| 26. | Petrolite PC-13 | Petrolite Corp. | Oxidized microcrystalline wax | 50 | 12.5 | 37.5 | 0 | 67 |
| 27. | Starwax 100 | Petrolite Corp. | Microcrystalline wax | 50 | 12.5 | 37.5 | 0 | 73 |

PPP - para-phenylphenol novolak resin
ZOP - zincated p-octylphenol novolak resin (4.3% Zn)
ADBSA - zincated di-tert-butylsalicylic acid (11.6% Zn)

From Examples I–III it can be seen that various CF coatings of the hot melt type can effectively be prepared, coated in fluid hot melt form, set by cooling, and joined with a CB sheet to produce a carbonless copy sheet which upon application of pressure gives good transfer and a sharp developed image. It is thus possible to utilize that hot melt CF coatings of Examples I–III in the continuous production of manifold carbonless forms, especially ones in which the CF coatings are spot coated as a savings.

The only requirement is that a hot melt coating or printing operation (i.e., one in which the coating is maintained at above melting point of the coating) is followed by a cooling step to set the resulting coating. As mentioned such a system is much less expensive and cumbersome, requires less floor space and requires less energy than systems which require expensive driers and/or solvent recovery systems.

While the method herein described constitutes a preferred embodiment of the invention, it is to be understood that the invention is not limited to this precise method, and that changes may be made therein without departing from the scope of the invention which is defined in the appended claims.

What is claimed is:

1. A hot melt chromogenic coating composition for the preparation of pressure-sensitive carbonless record sheets, said hot melt chromogenic coating composition being non-aqueous and solvent-free, said hot melt chromogenic coating composition additionally being water insoluble and having a melting point of from about 60° C. to about 140° C., said coating composition comprising from about 15% to 85% by weight of a chromogenic material, said chromogenic material being a meltable color developer of the acidic electron accepting type, said chromogenic material being selected from the group consisting of 3,5 di-tert-butyl salicylic acid, phenol resins of the novolak type, zinc salts of 3,5 di-tert-butyl salicylic acid and zinc modified novolak resins and mixtures thereof, and from about 15% to about 85% by weight of a rheology modifying material said coating composition, when set, being characterized by the absence of any free liquid.

2. The coating composition of claim 1 wherein said rheology modifying material is selected from the group consisting of: resins, waxes and liquid plasticizers.

3. The coating composition of claim 1 wherein said rheology modifying material is selected from the group consisting of polyethylenes, polypropylenes, polyethylene glycols, polystyrenes, polyesters, polyacrylates, rosin, modified rosins, polyphenyls, fatty acid derivatives, oxazoline waxes, montan waxes, paraffin waxes, microcrystalline waxes and combinations thereof.

4. The coating composition of claim 1 wherein said chromogenic material includes a zinc modified phenolic novolak resin.

5. The coating composition of claim 1 wherein said chromogenic material includes a phenolic novolak resin.

6. The coating composition of claim 1 wherein said chromogenic material includes a zinc salt of 3,5 di-tert-butyl salicylic acid.

7. The coating composition of claim 1 wherein said chromogenic material includes 3,5 di-tert-butyl salicylic acid.

* * * * *